US010283062B2

(12) United States Patent
Jin et al.

(10) Patent No.: US 10,283,062 B2
(45) Date of Patent: May 7, 2019

(54) DISPLAY WITH PIXEL DIMMING FOR CURVED EDGES

(71) Applicant: Apple Inc., Cupertino, CA (US)

(72) Inventors: Jiayi Jin, Saratoga, CA (US); Myung-Je Cho, San Jose, CA (US); Paolo Sacchetto, Cupertino, CA (US); Weijun Yao, Saratoga, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/767,637

(22) PCT Filed: Jul. 17, 2017

(86) PCT No.: PCT/US2017/042437
§ 371 (c)(1),
(2) Date: Apr. 11, 2018

(87) PCT Pub. No.: WO2018/026503
PCT Pub. Date: Feb. 8, 2018

(65) Prior Publication Data

US 2018/0308413 A1 Oct. 25, 2018

Related U.S. Application Data

(60) Provisional application No. 62/371,165, filed on Aug. 4, 2016.

(51) Int. Cl.
*G09G 3/36* (2006.01)
*G09G 3/20* (2006.01)

(52) U.S. Cl.
CPC ..... *G09G 3/3607* (2013.01); *G09G 3/20* (2013.01); *G09G 2310/0232* (2013.01); *G09G 2320/0285* (2013.01); *G09G 2320/0626* (2013.01)

(58) Field of Classification Search
CPC ..... G09G 3/3607; G09G 2320/0626; G09G 2320/0285; G09G 2310/0232
See application file for complete search history.

(56) References Cited

U.S. PATENT DOCUMENTS 9,696,598 B1 7/2017 Long et al.
2014/0071175 A1 3/2014 Yang et al.
(Continued)

FOREIGN PATENT DOCUMENTS

CN 104570457 A 4/2015
CN 105470264 A 4/2016
(Continued)

*Primary Examiner* — Liliana Cerullo
(74) *Attorney, Agent, or Firm* — Treyz Law Group, P.C.; Joseph F. Guihan

(57) ABSTRACT

A display may have curved edges such as rounded corners. Pixels in the display may be controlled so that the active area of the display has the desired curved edge shape. In order to maximize the apparent smoothness of the curved edge, the display may include circuitry that dims some of the pixels based on their location relative to a spline for the curved edge. The display circuitry may include a multiplication circuit that receives image data as a first input and dimming factors from a gain table as a second input. The image data may include a brightness level for each pixel in the array of pixels. The multiplication circuit may multiply the brightness level for each pixel by its respective dimming factor. This modified image data may then be supplied to the imaging pixels using display driver circuitry.

15 Claims, 10 Drawing Sheets

(56) References Cited

U.S. PATENT DOCUMENTS

| | | | | |
|---|---|---|---|---|
| 2016/0178940 | A1 | 6/2016 | Yuan et al. | |
| 2016/0189601 | A1 | 6/2016 | Jung et al. | |
| 2016/0267847 | A1* | 9/2016 | Chen | G09G 3/3283 |
| 2017/0160603 | A1* | 6/2017 | Zhang | G02F 1/133512 |

FOREIGN PATENT DOCUMENTS

| | | | |
|---|---|---|---|
| CN | 105514134 | | 4/2016 |
| CN | 105741736 | A | 7/2016 |
| EP | 2709090 | A1 | 3/2014 |
| KR | 20020085791 | A | 11/2002 |
| KR | 20070021241 | A | 2/2007 |
| KR | 20080008980 | A | 1/2008 |
| KR | 20090041336 | A | 4/2009 |
| KR | 20110056705 | A | 5/2011 |
| KR | 20120049816 | A | 5/2012 |
| WO | 2017110721 | A1 | 6/2017 |
| WO | 2010008570 | A | 1/2018 |

* cited by examiner

DISPLAY WITH PIXEL DIMMING FOR CURVED EDGES

This application claims priority to U.S. provisional patent application No. 62/371,165, filed on Aug. 4, 2016, which is hereby incorporated by reference herein in its entirety.

BACKGROUND

This relates generally to electronic devices, and, more particularly, to electronic devices with displays.

Electronic devices such as cellular telephones, computers, and wristwatch devices often include displays. For example, an electronic device may have an organic light-emitting diode display based on organic-light-emitting diode pixels or a liquid crystal display based on liquid crystal pixels. Conventional displays may have a rectangular shape with an outline that has right angles in each of its four corners. However, this type of shape may not match the desired aesthetic for the electronic device.

It would therefore be desirable to be able to provide improved displays for electronic devices.

SUMMARY

A display may have an array of pixels. The display may be a liquid crystal display, may be an organic light-emitting diode display, or may be a display of other types.

In a display, the array of pixels may form an active area of the display. It may sometimes be desirable for the active area of the display to have curved edges. For example, the active area may have four sides that are connected by four rounded corners. Each rounded corner may be defined by a spline.

Pixels in the pixel array may be controlled so that the active area of the display has the desired curved edge shape. In one scheme, pixels that are within the spline will be turned on while pixels that are not within the spline will be turned off. However, this type of arrangement may result in the curved edge appearing jagged to the user. In order to maximize the apparent smoothness of the curved edge, the display may include circuitry that dims some of the pixels without turning them entirely off.

The display circuitry may include a multiplication circuit that receives image data as a first input and dimming factors from a gain table as a second input. The image data may include a brightness level for each pixel in the array of pixels. The gain table may include a dimming factor for each pixel in the array of pixels. The multiplication circuit may multiply the brightness level for each pixel by its respective dimming factor. This modified image data may then be supplied to the imaging pixels using display driver circuitry.

The dimming factor for each pixel may be a function of the distance of the pixel from the spline. The dimming factor for each pixel may also be a function of the linear velocity associated with the location of the pixel.

DETAILED DESCRIPTION

Figure 1:
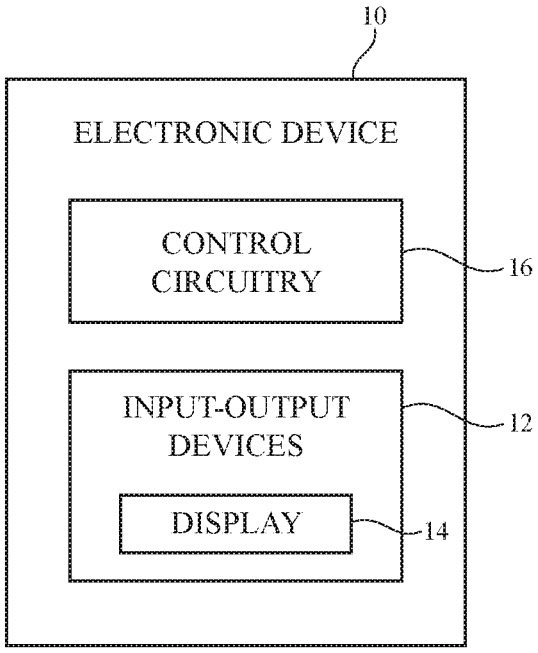
FIG. 1 is a schematic diagram of an illustrative electronic device having a display in accordance with an embodiment.

An illustrative electronic device of the type that may be provided with a display is shown in FIG. 1. Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a display, a computer display that contains an embedded computer, a computer display that does not contain an embedded computer, a gaming device, a navigation device, an embedded system such as a system in which electronic equipment with a display is mounted in a kiosk or automobile, or other electronic equipment.

As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements. A touch sensor for display 14 may be formed from electrodes formed on a common display substrate with the pixels of display 14 or may be formed from a separate touch sensor panel that overlaps the pixels of display 14. If desired, display 14 may be insensitive to touch (i.e., the touch sensor may be omitted).

Control circuitry 16 may be used to run software on device 10 such as operating system code and applications. During operation of device 10, the software running on control circuitry 16 may display images on display 14.

Figure 2:
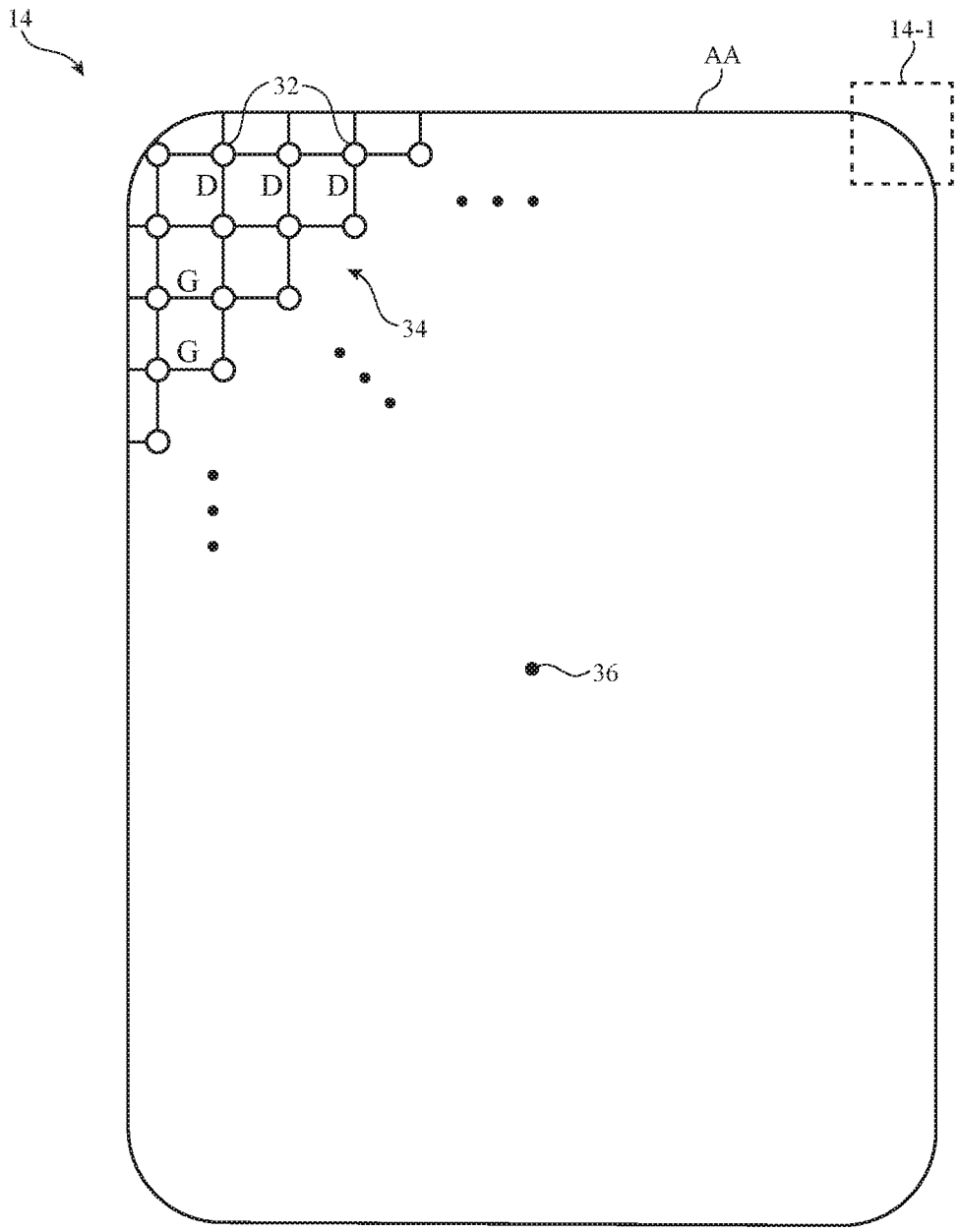
FIG. 2 is a top view of an illustrative array of pixels for a display with rounded corners in accordance with an embodiment.

FIG. 2 shows an illustrative display with an active area AA that has four sides and four curved (rounded) corners. The active area of display 14 may have a center 36. Other display shapes with one or more curved edges may be used in forming display 14, if desired. Display 14 may have an array of pixels 32 for displaying images for a user such as pixel array 34. Pixels 32 in array 34 may be arranged in rows and columns The edges of array 34 may be curved (i.e., some rows of pixels 32 and/or some columns of pixels 32 in array 34 may have a different length). There may be any suitable number of rows and columns in array 34 (e.g., ten or more, one hundred or more, or one thousand or more, etc.). Display 14 may include pixels 32 of different colors. As an example, display 14 may include red pixels, green pixels, and blue pixels. In some cases, a single pixel may be said to include a red sub-pixel, a blue sub-pixel, and a green sub-pixel. However, these sub-pixels may sometimes be referred to as pixels themselves (i.e., a red pixel, a blue pixel, a green pixel, etc.) If desired, a backlight unit may provide backlight illumination for display 14.

Display driver circuitry may be used to control the operation of pixels 32. The display driver circuitry may be formed from integrated circuits, thin-film transistor circuits, or other suitable circuitry formed in the inactive area of the display. The display driver circuitry may be able to communicate with system control circuitry (i.e., control circuitry 16). During operation, the control circuitry may supply circuitry such as a display driver integrated circuit with image data for images to be displayed on display 14. To display the images on pixels 32, the display driver circuitry may supply corresponding image data to data lines D and assert gate line signals on gate lines G in sequence, starting with the gate line signal G in the first row of pixels 32 in array 34. As each gate line is asserted, data from data lines D may be loaded into a corresponding row of pixels. In this way, the control circuitry may provide pixels 32 with signals that direct pixels 32 to display a desired image on display 14. Horizontal control lines G (sometimes referred to as gate lines, scan lines, emission control lines, etc.) may run horizontally through display 14 and be associated with respective rows of pixels 32, while data lines D may run vertically through display 14 and be associated with respective columns of pixels 32.

As shown in FIG. 2, the active area of a display may sometimes be provided with curved edges. This type of shape may maximize the size of the active area of the display. However, ensuring that the curved edges of the display appear smooth and aesthetically pleasing may be challenging. An enlarged portion of the display (14-1) from FIG. 2 is shown in FIG. 3 to illustrate some of these challenges.

Figure 3:
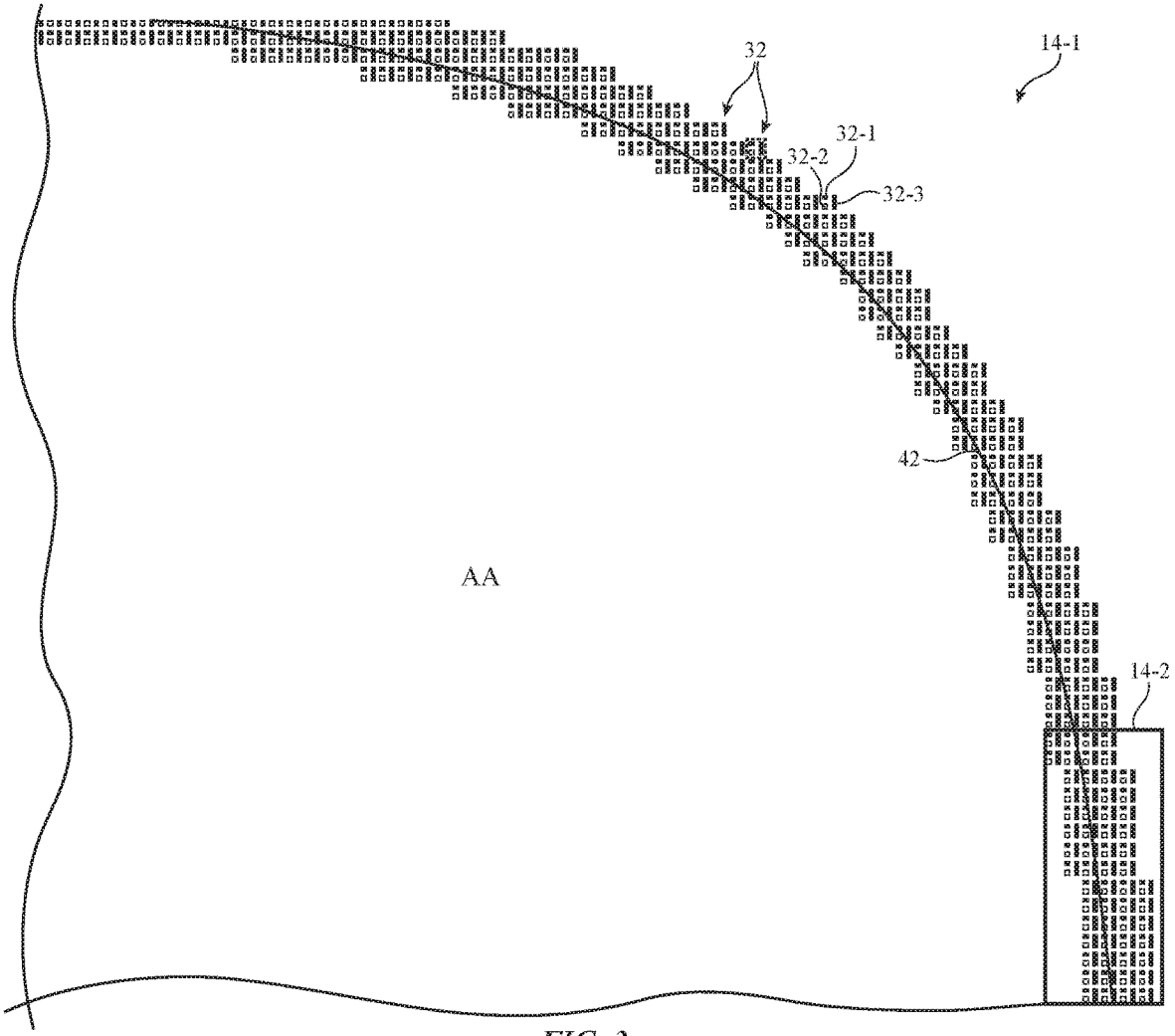
FIG. 3 is a top view of an illustrative spline for a display with rounded corners in accordance with an embodiment.

FIG. 3 shows a plurality of pixels 32 that are a part of pixel array 34. In order for display 14 to have rounded corners as shown in FIG. 2, the pixels may follow a spline 42 (sometimes referred to herein as a spline curve or a spline edge). The spline may be the optimal outline for the active area of the display. Ideally, uniform light would be emitted at all points inside the spline and no light would be emitted at points outside of the spline. This would ensure that the active area displays a curve that appears smooth to a user of the electronic device. However, because individual pixels in the display may be discernable to a user, selectively enabling pixels to try to follow the spline may result in a curved edge that appears jagged to the user along the spline. The jagged edges that may result are depicted in FIG. 4, which shows a zoomed-in version of portion 14-2 of the spline and active area.

First, it should be noted that each pixel 32 may contain three sub-pixels 32-1, 32-2, and 32-3. Sub-pixel 32-1 may be a red sub-pixel, sub-pixel 32-2 may be a green sub-pixel, and sub-pixel 32-3 may be a blue sub-pixel. Each pixel 32 may have red, green, and blue sub-pixels 32-1, 32-2, and 32-3 arranged as shown in FIG. 4. Sometimes the sub-pixels may be referred to as pixels. In each pixel, the red sub-pixel may be positioned on top of the green sub-pixel, and the blue sub-pixel may be positioned to the right of the red and green sub-pixels. This example of a pixel layout is merely illustrative, and any desired pixels or sub-pixels may be used in display 14.

Figure 4:
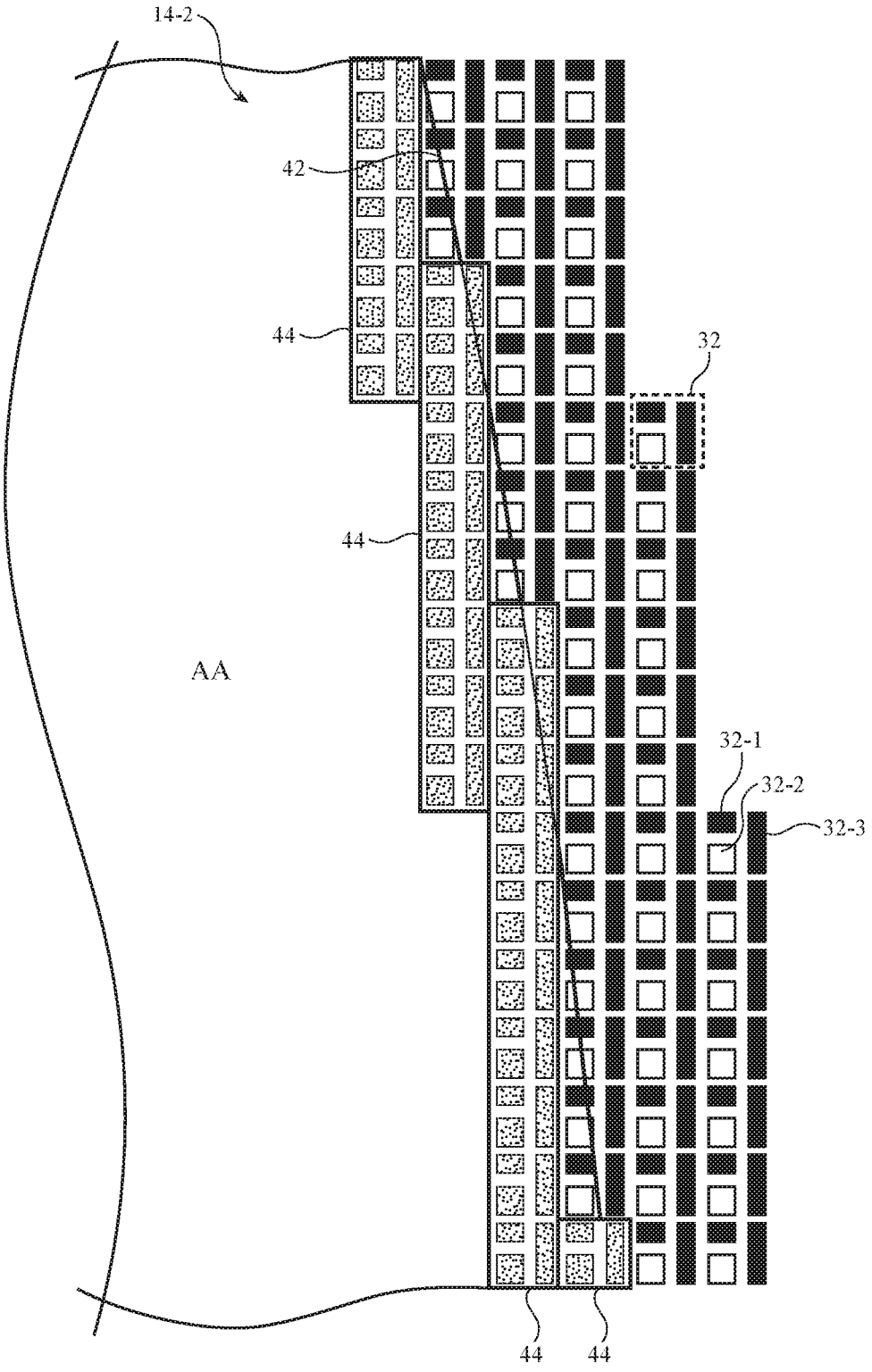
FIG. 4 is a zoomed-in image of the illustrative spline of FIG. 3 showing how the display may have jagged edges in accordance with an embodiment.

FIG. 4 shows a pixel scheme for forming the spline edge where each pixel is controlled individually to be either on or off. As shown, pixels that are within the spline edge are turned on (i.e., these pixels are capable of emitting light), while pixels that are not within the spline edge are turned off (i.e., these pixels are not capable of emitting light and will be dark). Illustrative pixel groups 44 show which pixels 32 may be considered within the spline edge and turned on. The remaining pixels will remain off. As is visible in FIG. 4 based on the shape of pixel groups 44, this type of pixel arrangement may result in the display having jagged edges.

Figure 5:
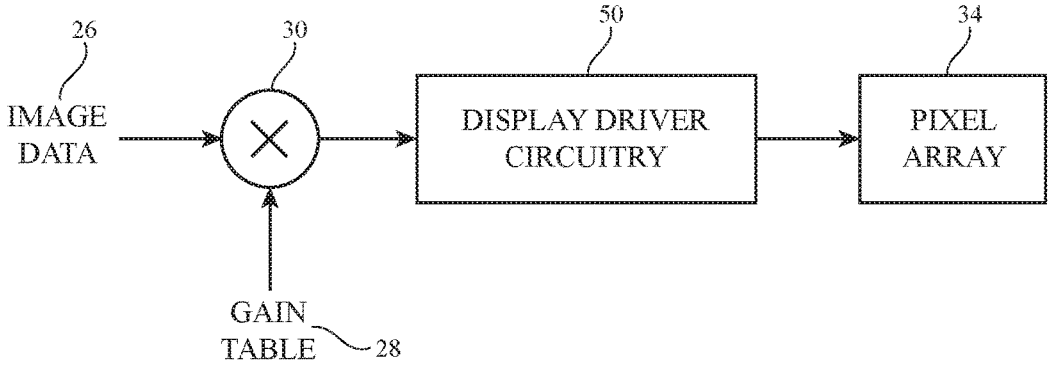
FIG. 5 is a schematic diagram of an illustrative display that modifies image data based on dimming factors in accordance with an embodiment.

In order to prevent jaggedness in the edges of the display, the display pixel data may be modified by dimming factors. FIG. 5 shows a schematic diagram of illustrative circuitry that may be used in implementing display 14 of device 10. During operation of electronic device 10, control circuitry in the device may supply image data 26 for images to be displayed on display 14. Ultimately, the image data may be delivered to display driver circuitry 50, which may supply the image data to data lines D of the display. Display driver circuitry 50 may also include gate driver circuitry which is used to assert gate line signals on gate lines G of display 14. The display driver circuitry may be used to provide the image data to the pixels in pixel array 34.

Before being provided to display driver circuitry 50, the image data may be multiplied by dimming factors from gain table 28 in multiplication circuit 30 (sometimes referred to herein as a gain circuit). Each frame of image data 26 may include a representative brightness value for each pixel 32 in pixel array 34. Gain table 28 may include a dimming factor for each pixel (or sub-pixel) 32 in pixel array 34. The dimming factor may be associated with the location of the pixel relative to the spline edge of the display. Each pixel that is within the spline edge of the display may have a dimming factor of 1 (meaning that the brightness level for that pixel will not be modified). Pixels that are outside the spline edge of the display may have a dimming factor between 0 and 1. When the brightness level for a pixel is multiplied by a dimming factor less than 1 in gain circuit 30, the brightness of that particular pixel will be reduced (i.e. dimmed). Dimming the pixels outside the spline edge of the display may enable the edge of the display to appear smoother to the user.

After image data 26 is multiplied by the dimming factors from gain table 28, the modified image data may be provided to display driver circuitry 50. Display driver circuitry 50 will then provide the modified image data to the pixels in pixel array 34. Pixel array may then display the desired image with curved edges that do not appear jagged to the user.

Multiplication circuit 30, gain table 28, display driver circuitry 50, and pixel array 34 as shown in FIG. 5 may sometimes be collectively referred to as display circuitry. Alternatively, pixel array 34 may sometimes be referred to as a display while multiplication circuit 30, gain table 28, and display driver circuitry 50 may sometimes collectively be referred to as control circuitry.

Figure 6:
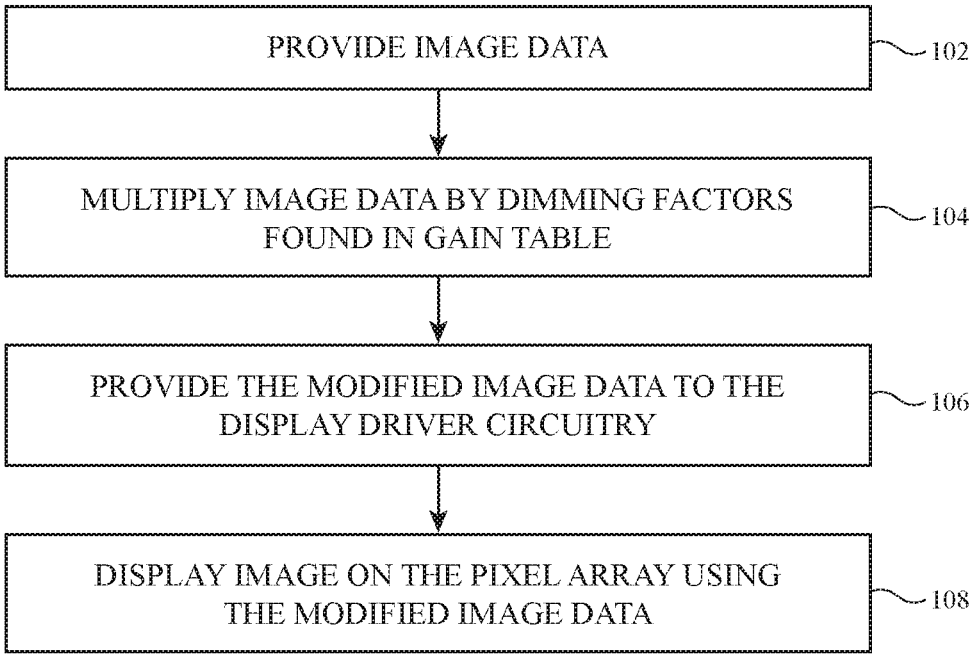
FIG. 6 is a flowchart of illustrative steps involved in operation of the display shown in FIG. 5 in accordance with an embodiment.

A flowchart showing illustrative method steps for modifying image data to achieve a smoother display edge is shown in FIG. 6. As shown, at step 102 image data (i.e., image data 26) may be provided. Once the image data is provided, the image data may be multiplied by dimming factors found in a gain table (i.e., gain table 28) at step 104. Each pixel may be multiplied by a dimming factor between 0 and 1 that is associated with the location of that particular pixel. After the image data has been modified, the modified image data may be provided to display driver circuitry (i.e., display driver circuitry 50) at step 106. Finally, at step 108 an image may be displayed using the pixels in the pixel array based on the modified image data. Display driver circuitry 50 may supply the modified image data to pixels 32 to display the image.

The method steps shown in FIG. 6 may be applied to any type of display. Fundamentally, the method involves adjusting the brightness levels of pixels to achieve a smooth curve. This type of method may be applied to light-emitting diode (LED) displays, organic light-emitting diode (OLED) displays, liquid crystal (LC) displays, liquid crystal on silicon (LCOS) displays, etc. The displays may be reflective displays, transmissive displays, transreflective displays, or any other desired type of display. In general, any type of display may be used.

Figure 7:
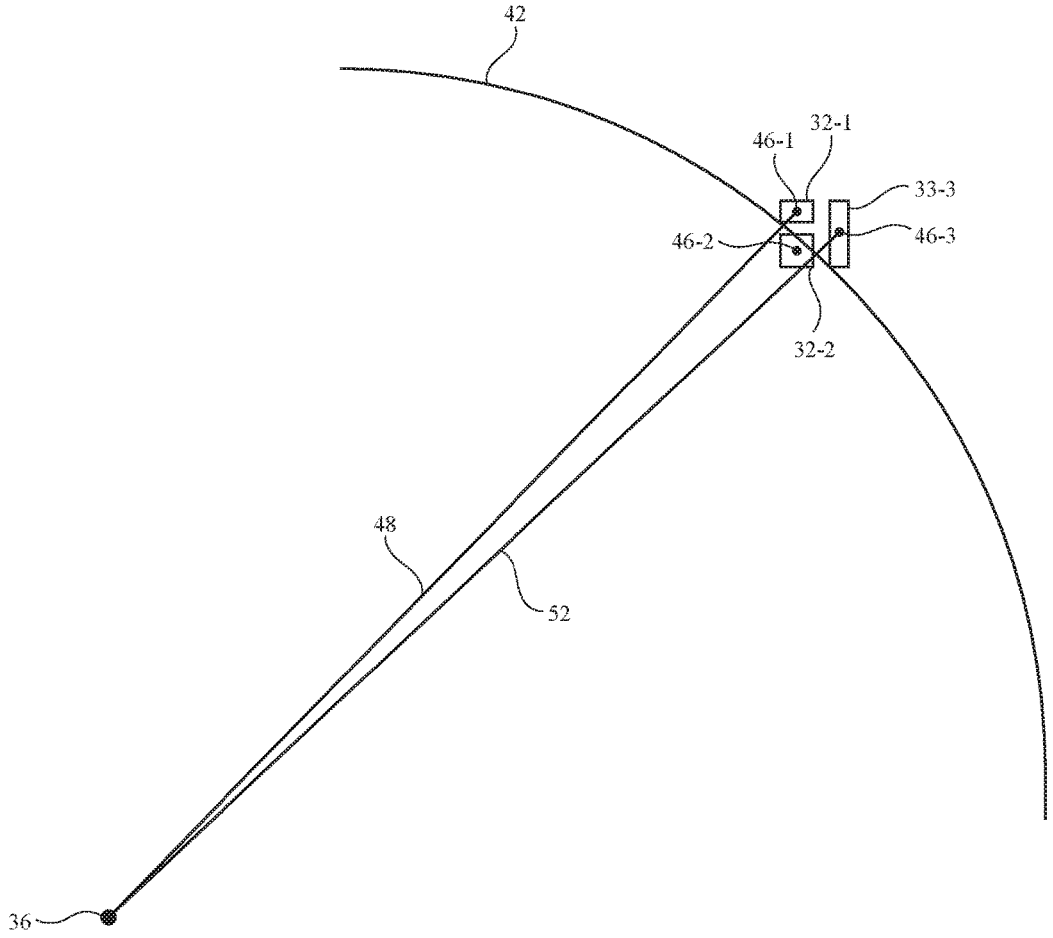
FIG. 7 is a top view of an illustrative display with a spline showing how the distance of sub-pixels from the spline may be determined in accordance with an embodiment.

The dimming factors used in gain table 28 may be determined in a variety of ways. In a first illustrative embodiment, a dimming factor may be associated with each sub-pixel in the pixel array (i.e., each pixel may have corresponding sub-pixels 32-1, 32-2, and 32-3 that all have respective dimming factors). The dimming factor may be based on the distance of the sub-pixel from the spline edge. FIG. 7 illustrates how distance of the sub-pixel from the spline edge may be used to determine a dimming factor for the sub-pixel. For simplicity, FIG. 7 shows just a single pixel, but it is understood that this type of dimming factor may be applied to any sub-pixel in the array. Additionally, it should be noted that FIG. 7 is not necessarily to scale and is merely illustrating the described concepts.

FIG. 7 shows spline edge 42 separated from center 36 of the display active area. Illustrative sub-pixels 32-1, 32-2, and 32-3 are shown in FIG. 7. Each sub-pixel may have a respective center. Center 46-1 may be the center of red sub-pixel 32-1, center 46-2 may be the center of green sub-pixel 32-2, and center 46-3 may be the center of blue sub-pixel 32-3. The dimming factor for any sub-pixel with a center within spline edge 42 may be 1. This means that any sub-pixel with a center within spline edge 42 will not be dimmed Sub-pixel 32-2 is an example of pixel with a center within the spline edge. As shown, sub-pixel 32-2's center 46-2 is positioned within the spline edge. Accordingly, the dimming factor for sub-pixel 32-2 in FIG. 7 is 1.

Sub-pixels that have a center outside of the spline edge may have a dimming factor less than 1. If a sub-pixel has a center outside of the spline edge, the dimming factor may be determined by the distance between the center of the sub-pixel and the spline edge. For example, sub-pixel 32-1 has a center 46-1 that is positioned outside of the spline edge. In order to determine the distance between center 46-1 and spline 42, a point on spline 42 must be selected as the relevant point for the measurement. This point is determined by drawing a line between the center of the sub-pixel and the center of the active area. This line is represented by line 48 in FIG. 7. As shown, line 48 is coupled between the center of the active area and the center of sub-pixel 32-1. A similar line may be used for sub-pixel 46-3. As shown, line 52 connects center 36 of the active area to center 46-3 of pixel 32-3. A zoomed-in version of the pixel shown in FIG. 7 is shown in FIG. 8.

Figure 8:
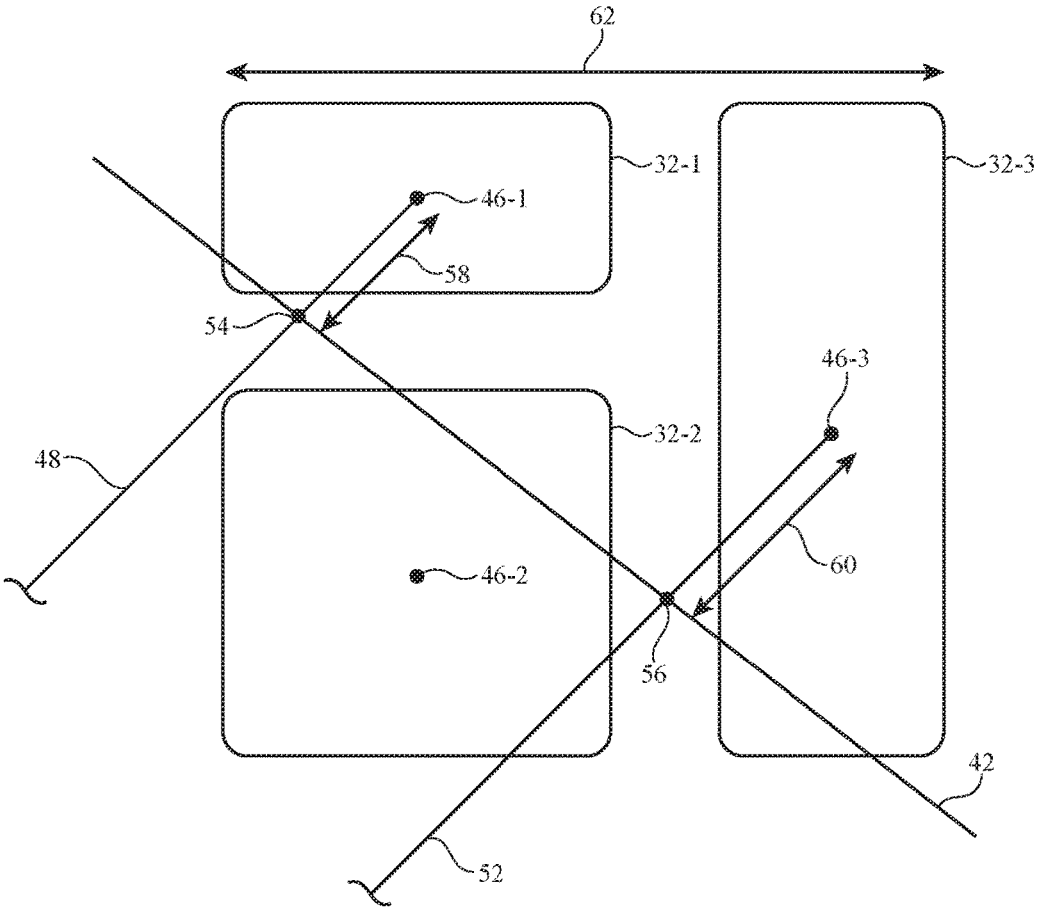
FIG. 8 is a zoomed-in image of FIG. 7 further demonstration how the distance of sub-pixels from the spline may be determined in accordance with an embodiment.

As shown in FIG. 8, point 54 may be the point on spline 42 directly between the center of the active area and the center of sub-pixel 32-1. The distance between point 54 and center 46-1 may be considered the distance 58 between sub-pixel 32-1 and spline 42. Similarly, point 56 may be the point on spline 42 directly between center 36 of the active area and center 46-3 of sub-pixel 32-3. The distance between point 56 and center 46-3 may be considered the distance 60 between sub-pixel 32-3 and spline 42.

In order to use the distance between the sub-pixel and the spline to calculate a dimming factor, the distance may be normalized by dividing the distance by the size of a pixel. For example, each pixel in the array may have a width 62, as shown in FIG. 8. The width or any other desired dimension of the pixel may be taken to represent the size of the pixel. Using pixel width as a representative of pixel size (as in this example) is merely illustrative and any other desired pixel dimension (i.e., length) may be used to represent pixel size. Normalized distance (d) may be determined by dividing the distance between the sub-pixel and the spline by the size of the pixel (i.e., d=distance/pixel size). The dimming factor (DF) for each sub-pixel outside of the spline may then be determined by the following equation: $DF=1-d$. In this equation, 'd' is the normalized distance of the sub-pixel from the spline as previously described. Using this equation, the dimming factor will progress from 1 to 0 as the sub-pixels get further away from the spline. For example, a sub-pixel that is very close the spline may have a dimming factor of 0.95 (meaning only a 5% reduction in brightness). In contrast, a sub-pixel that is further away from the spline may have a dimming factor of 0.05 (meaning a 95% reduction in brightness). The minimum dimming factor may be 0. This means that sub-pixels that have a distance from the spline greater than 1 pixel width may always be turned off.

Figure 9:
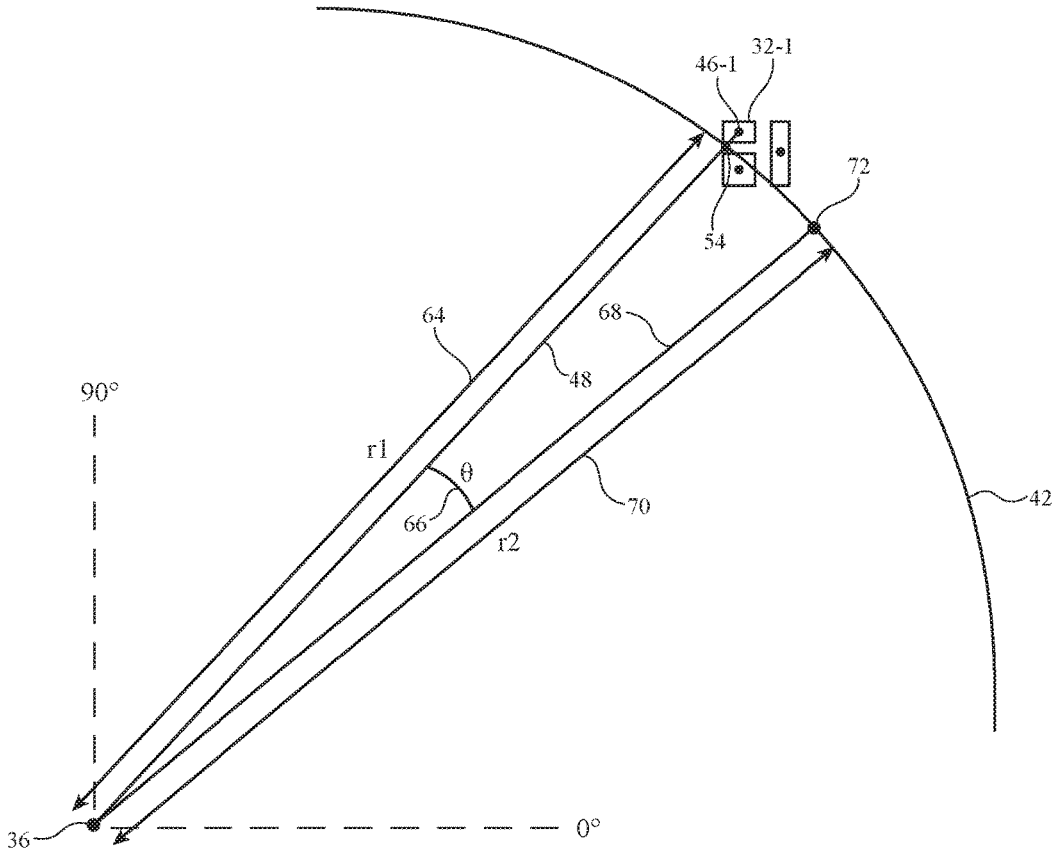
FIG. 9 is a top view of an illustrative display with a spline showing how the linear velocity associated with a given sub-pixel may be determined in accordance with an embodiment.

Modifying the image data based on the distance between sub-pixels and the spline may improve the apparent smoothness of the edges of the display. However, further improvements may be made by adjusting the dimming factor not only based on distance between the sub-pixel and the spline, but also the linear velocity of the spline. Information on obtaining the linear velocity of the spline is shown in FIG. 9. Linear velocity may depend on the contour of the spline at a location on the spline associated with the location of the pixel of interest. For simplicity, FIG. 9 shows just a single pixel, but it is understood that this type of dimming factor may be applied to any sub-pixel in the array. Additionally, it should be noted that FIG. 9 is not necessarily to scale and is merely illustrating the described concepts.

FIG. 9 shows spline edge 42 separated from center 36 of the display active area. Illustrative sub-pixels 32-1, 32-2, and 32-3 are shown in FIG. 9. Each sub-pixel may have a respective center as described in connection with FIG. 7. Center 46-1 may be the center of red sub-pixel 32-1. Each sub-pixel may have a corresponding linear velocity function (LVF) determined by the linear velocity (LV) associated with the center of the particular sub-pixel. Sub-pixel 32-1 will now be examined as an example of obtaining linear velocity. As described in connection with FIGS. 7 and 8, a line 48 may be drawn from the center 36 of the active area to the center of sub-pixel 32-1. This line may intersect spline 42 at point 54 as shown. Point 54 may be the point on the spline directly between the center of the active area and the center of sub-pixel 32-1. The distance between center 36 and point 54 along line 48 may be characterized by distance 64. This distance may sometimes be referred to as r1. Next, another line 68 may be drawn that is separated from line 48 by an angle 66 (θ). The angle may be approximately 1° or any other desired angle (i.e., 0.5°, 0.1°, less than 0.1°, greater than 0.1°, etc.). Line 68 may have a point of intersection with spline 42 (point 72). Point 72 may be the point on the spline directly between the center of the active area and the center of sub-pixel 32-3. The distance between center 36 and point 72 along line 68 may be characterized by distance 70. This distance may sometimes be referred to as r2. The linear velocity (LV) may subsequently be determined using the following equation: $LV=(r2-r1)/\theta$.

The linear velocity may be used to determine a linear velocity function (LVF). The linear velocity function may simply be the linear velocity adjusted by some constants to optimize smoothness in the display. The following equation may be used to determine the linear velocity function: $LVF=(LV/a)+b$. The constants 'a' and 'b' may be selected to achieve maximum smoothness of the display edges. Finally, the dimming factor for each pixel may be determined using a similar formula as previously described above. However, instead of determining the dimming factor solely as a function distance (as previously described), the dimming factor (DF) may be determined as a function of distance and linear velocity using the following formula: $DF=1-(d/LVF)$. In this formula, is the normalized distance of the sub-pixel from the spline as previously described and LVF is the linear velocity function as previously described.

In FIGS. 7-9, the center of the active area (36) is used as a reference point for determining dimming factors for display pixels. However, this example is merely illustrative. Any desired location on the display panel may be used as a reference point in determining the linear velocities and dimming factors of pixels.

Figure 10:
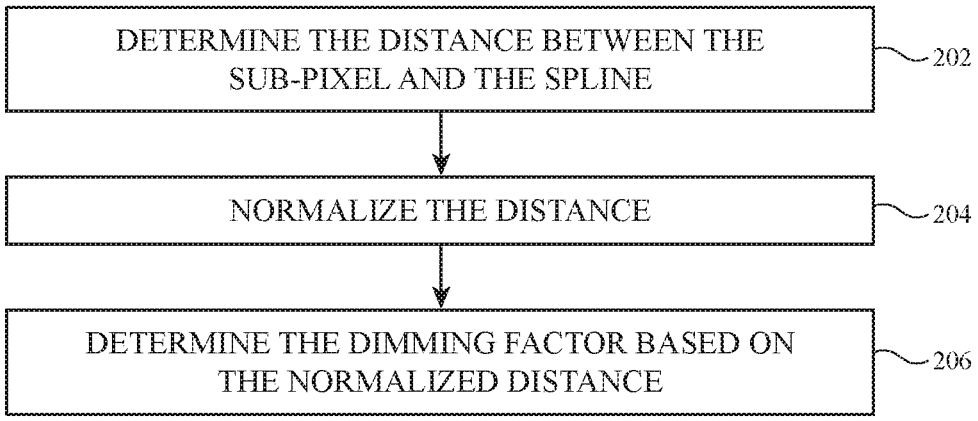
FIG. 10 is a flowchart of illustrative steps involved in determining dimming factors for sub-pixels based on the distance of the sub-pixel from the spline in accordance with an embodiment.
Figure 11:
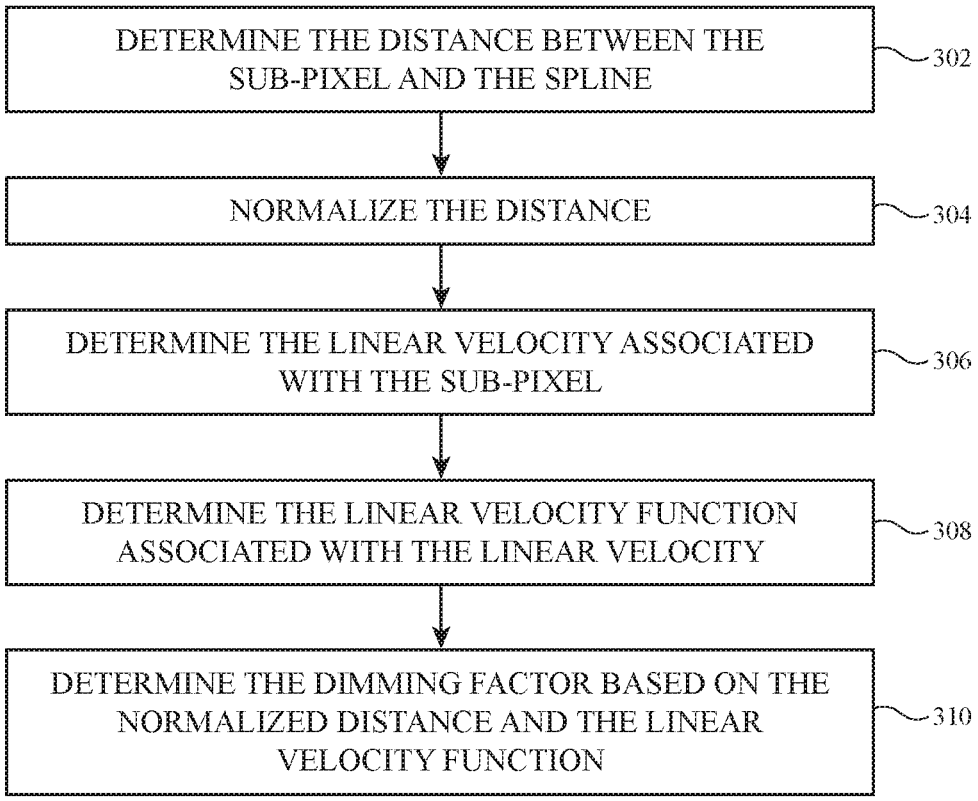
FIG. 11 is a flowchart of illustrative steps involved in determining dimming factors for sub-pixels based on the distance of the sub-pixel from the spline and the linear velocity associated with the sub-pixel in accordance with an embodiment.

FIGS. 10 and 11 show illustrative methods for determining dimming factors for sub-pixels in the display. FIG. 10 shows a method of determining the dimming factor as a function of the distance between the sub-pixel and the spline. At step 202, the distance between the sub-pixel and the spline may be determined, as described in connection with FIGS. 7 and 8. The distance may then be normalized at step 204. The distance may be normalized by dividing the distance between the sub-pixel and the spline by pixel size. The pixel size may be any representative dimension of a pixel. For example, the width of the pixel, the height of the pixel, or the diagonal dimension of the pixel may be used. Once normalized, the dimming factor may be determined based on the normalized distance at step 206.

FIG. 11 shows a method of determining the dimming factor as a function of the distance between the sub-pixel and the spline and as a function of the linear velocity associated with the sub-pixel. As shown, at step 302 the distance between the sub-pixel and the spline may be determined, as described in connection with FIGS. 7 and 8. The distance may then be normalized at step 304. The distance may be normalized by dividing the distance between the sub-pixel and the spline by pixel size. The pixel size may be any representative dimension of a pixel. For example, the width of the pixel, the height of the pixel, or the diagonal dimension of the pixel may be used. At step 306, the linear velocity associated with the sub-pixel may be determined, as described in connection with FIG. 9.

It should be noted that instead of precisely calculating the linear velocity for each and every sub-pixel, the linear velocity may instead be determined using a look-up table and interpolation. The point between each sub-pixel center and the active area center on the spline has an angle relative to the active area center (i.e., 0°, 10°, 40°, 90°, etc.). The linear velocity for certain angles (i.e., every whole degree) may be stored in a look-up table. Take an example where a given sub-pixel has a representative angle of 22.3°. The linear velocities associated with 22° and 23° may be obtained from the look-up table, and interpolation may be performed to approximate a linear velocity for 22.3°. Any desired type of interpolation may be performed (i.e., linear, polynomial, etc.).

At step 308, the linear velocity may be used to determine the linear velocity function (i.e., the linear velocity may be modified using known constants). Finally, at step 310, the dimming factor may be determined based on the normalized distance and the linear velocity function.

In various embodiments, an electronic device may include a display and control circuitry configured to provide image data to the display. The display may include an array of pixels that form an active area of the display, the active area of the display may have an edge that has at least one rounded corner, and the at least one rounded corner may be defined by a spline. The image data may include a brightness value for each pixel in the array of pixels, the control circuitry may include a multiplication circuit configured to modify the image data by multiplying the image data by dimming factors, each pixel in the array of pixels may have a respective dimming factor, and the dimming factor associated with each pixel may be a function of a linear velocity associated with a location of the respective pixel.

The multiplication circuit may be configured to modify the image data by multiplying the brightness value for each pixel in the array of pixels by the dimming factor associated with the pixel. The control circuitry may include display driver circuitry that provides the modified image data to the array of pixels, and the array of pixels may display an image based on the modified image data. The dimming factor associated with each pixel may also be a function of a distance of the respective pixel to the spline. The dimming factor for each pixel may decrease as the distance of the pixel to the spline increases. The distance of the pixel to the spline may be measured as the distance from a center of the pixel to the spline. The dimming factor for pixels that are within the spline may be 1. The dimming factor associated with each pixel may be a function of a normalized distance of the respective pixel to the spline. The dimming factor for pixels that are greater than one pixel width outside of the spline may be 0. The linear velocity associated with the location of each pixel may be determined by a contour of the spline at the location. The edge of the active area of the display may have four sides with four rounded corners.

In various embodiments, display circuitry may include an array of pixels configured to display images, a gain table that includes a dimming factor for each pixel in the array of pixels, and a multiplication circuit that is configured to receive image data. The image data may include a brightness value for each pixel in the array of pixels, the multiplication circuit may be configured to multiply the brightness value for each pixel by the dimming factor associated with the pixel to obtain modified image data, and the dimming factor for each pixel may be a function of a distance between the respective pixel and a spline. The display circuitry may also include display driver circuitry configured to provide the modified image data to the array of pixels.

In various embodiments, a method of operating a display that has a plurality of pixels and at least one curved edge defined by a spline may include providing image data to the display that includes brightness levels for each pixel in the plurality of pixels and modifying the image data based on dimming factors. Each pixel may have a respective dimming factor and the dimming factor for each pixel may be a function of a linear velocity that is associated with a location of the respective pixel. The method may also include displaying an image using the plurality of pixels based on the modified image data. The dimming factor for each pixel may also be a function of a normalized distance between the respective pixel and the spline.

In accordance with an embodiment, an electronic device is provided that includes a display that includes an array of pixels that form an active area of the display, the active area of the display has an edge that has at least one rounded corner, and the at least one rounded corner is defined by a spline, and control circuitry configured to provide image data to the display, the image data includes a brightness value for each pixel in the array of pixels, the control circuitry includes a multiplication circuit configured to modify the image data by multiplying the image data by dimming factors, each pixel in the array of pixels has a respective dimming factor, and the dimming factor associated with each pixel is a function of a linear velocity associated with a location of the respective pixel.

In accordance with another embodiment, the multiplication circuit is configured to modify the image data by multiplying the brightness value for each pixel in the array of pixels by the dimming factor associated with the pixel.

In accordance with another embodiment, the control circuitry includes display driver circuitry that provides the modified image data to the array of pixels, and the array of pixels displays an image based on the modified image data.

In accordance with another embodiment, the dimming factor associated with each pixel is also a function of a distance of the respective pixel to the spline.

In accordance with another embodiment, the dimming factor for each pixel decreases as the distance of the pixel to the spline increases.

In accordance with another embodiment, the distance of the pixel to the spline is measured as the distance from a center of the pixel to the spline.

In accordance with another embodiment, the dimming factor for pixels that are within the spline is 1.

In accordance with another embodiment, the dimming factor associated with each pixel is a function of a normalized distance of the respective pixel to the spline.

In accordance with another embodiment, the dimming factor for pixels that are greater than one pixel width outside of the spline is 0.

In accordance with another embodiment, the linear velocity associated with the location of each pixel is determined by a contour of the spline at the location.

In accordance with another embodiment, the edge of the active area of the display has four sides with four rounded corners.

In accordance with an embodiment, display circuitry is provided that includes an array of pixels configured to display images, a gain table that includes a dimming factor for each pixel in the array of pixels, a multiplication circuit that is configured to receive image data, the image data includes a brightness value for each pixel in the array of pixels, the multiplication circuit is configured to multiply the brightness value for each pixel by the dimming factor associated with the pixel to obtain modified image data, and the dimming factor for each pixel is a function of a distance between the respective pixel and a spline, and display driver circuitry configured to provide the modified image data to the array of pixels.

In accordance with another embodiment, the dimming factor for each pixel decreases as the distance between the pixel and the spline increases.

In accordance with another embodiment, the distance between each pixel and the spline is measured as the distance from a center of the respective pixel to the spline.

In accordance with another embodiment, the dimming factor for pixels that are within the spline is 1.

In accordance with another embodiment, the dimming factor associated with each pixel is a function of a normalized distance between the respective pixel and the spline.

In accordance with another embodiment, the dimming factor for pixels that are greater than one pixel width outside of the spline is 0.

In accordance with another embodiment, the dimming factor associated with each pixel is also a function of a linear velocity associated with a location of the respective pixel.

In accordance with an embodiment, a method of operating a display that has a plurality of pixels and at least one curved edge defined by a spline is provided that includes providing image data to the display, the image data includes brightness levels for each pixel in the plurality of pixels, modifying the image data based on dimming factors, each pixel has a respective dimming factor, and the dimming factor for each pixel is a function of a linear velocity that is associated with a location of the respective pixel and displaying an image using the plurality of pixels based on the modified image data.

In accordance with another embodiment, the dimming factor for each pixel is also a function of a normalized distance between the respective pixel and the spline.

In accordance with an embodiment, an electronic device is provided that includes a display that includes a plurality of pixels that form an active area of the display, wherein the active area of the display has at least one rounded corner along at least a portion of an edge of the active area of the display, and control circuitry configured to provide image data to the display, wherein the image data comprises a brightness value for each pixel, wherein the control circuitry comprises circuitry configured to modify the image data based on at least one dimming factor, wherein each pixel has a respective dimming factor, and wherein the dimming factor associated with each pixel is associated with at least a location of the respective pixel.

In accordance with another embodiment, the circuitry configured to modify the image data comprises a multiplication circuit configured to multiply the brightness value for each pixel by the dimming factor associated with the pixel.

In accordance with another embodiment, the control circuitry includes display driver circuitry that provides the modified image data to the plurality of pixels and the plurality of pixels displays an image based on the modified image data.

In accordance with another embodiment, the dimming factor associated with each pixel at least is associated with a linear velocity associated with the location of each pixel and the linear velocity is determined at least by a contour of a spline of the at least one rounded corner at the location.

In accordance with another embodiment, the dimming factor associated with each pixel is at least associated with a linear velocity associated with the location of the respective pixel and a distance of the respective pixel to a spline of the at least one rounded corner.

In accordance with another embodiment, the dimming factor for each pixel decreases as the distance of the pixel to the spline increases.

In accordance with another embodiment, the distance of the pixel to the spline is measured as a distance from a center of the pixel to the spline.

In accordance with another embodiment, the dimming factor for pixels that are within a predetermined distance to the spline is 1.

In accordance with another embodiment, the dimming factor for pixels that are greater than one pixel width outside of the spline is 0.

In accordance with another embodiment, the dimming factor associated with each pixel at least is associated with a normalized distance of the respective pixel to a spline of the at least one rounded corner.

In accordance with another embodiment, the display has four sides with four rounded corners.

In accordance with an embodiment display circuitry for a display is provided including a plurality of pixels configured to display images, a multiplication circuit that is configured to receive image data, wherein the image data includes a brightness value for each pixel of the plurality of pixels, wherein the multiplication circuit is configured at least to multiply the brightness value for each pixel by a dimming factor associated with the pixel to obtain modified image data, and wherein the dimming factor for each pixel at least is a function of a distance between the respective pixel and a spline of the display, and display driver circuitry configured to provide the modified image data to the plurality of pixels.

In accordance with another embodiment, the display circuitry also includes a gain table that includes the dimming factor for each pixel, wherein the dimming factor for each pixel decreases as the distance between the pixel and the spline increases.

In accordance with another embodiment, the distance between each pixel and the spline is measured as a distance from a center of the respective pixel to the spline.

In accordance with another embodiment, the dimming factor for pixels that are within a predetermined distance to the spline is 1.

In accordance with another embodiment, the dimming factor for pixels that are greater than one pixel width outside of the spline is 0.

In accordance with another embodiment, the dimming factor associated with each pixel at least is associated with a normalized distance between the respective pixel and the spline.

In accordance with another embodiment, the dimming factor associated with each pixel is also at least associated with a linear velocity associated with a location of the respective pixel.

In accordance with an embodiment, a method of operating a display that has a plurality of pixels and at least one curved edge is provided that includes providing image data to the display, wherein the image data comprises brightness levels for each pixel in the plurality of pixels, modifying the image data based on dimming factors, wherein each pixel has a respective dimming factor, and wherein the dimming factor for each pixel at least is associated with a location of the respective pixel, and displaying an image using the plurality of pixels based on the modified image data.

In accordance with another embodiment, the dimming factor for each pixel at least is associated with a linear velocity that is associated with the location of the respective pixel and the dimming factor for each pixel at least is associated with a normalized distance between the respective pixel and a spline of the at least one curved edge.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

a display that includes a plurality of pixels that form an active area of the display, wherein the active area of the display has at least one rounded corner along at least a portion of an edge of the active area of the display; and control circuitry configured to provide image data to the display, wherein the image data comprises a brightness value for each pixel, wherein the control circuitry comprises circuitry configured to modify the image data based on at least one dimming factor, wherein each pixel has a respective dimming factor, wherein the dimming factor associated with each pixel is associated with at least a location of the respective pixel, and wherein the dimming factor associated with each pixel is at least a function of a distance of the respective pixel to a spline of the at least one rounded corner.

2. The electronic device defined in claim 1, wherein the circuitry configured to modify the image data comprises a multiplication circuit configured to multiply the brightness value for each pixel by the dimming factor associated with the pixel.

3. The electronic device defined in claim 2, wherein the control circuitry includes display driver circuitry that provides the modified image data to the plurality of pixels, and wherein the plurality of pixels displays an image based on the modified image data.

4. The electronic device defined in claim 3, wherein the dimming factor associated with each pixel is at least associated with a contour of the spline of the at least one rounded corner at the location.

5. The electronic device defined in claim 1, wherein the dimming factor for each pixel decreases as the distance of the pixel to the spline increases.

6. The electronic device defined in claim 1, wherein the distance of the pixel to the spline is measured as a distance from a center of the pixel to the spline.

7. The electronic device defined in claim 1, wherein the dimming factor for pixels that are greater than one pixel width outside of the spline is 0.

8. The electronic device defined in claim 1, wherein the dimming factor associated with each pixel at least a function of a normalized distance of the respective pixel to the spline of the at least one rounded corner.

9. The electronic device defined in claim 1, wherein the display has four sides with four rounded corners.

10. Display circuitry for a display comprising:

a plurality of pixels configured to display images;

a multiplication circuit that is configured to receive image data, wherein the image data includes a brightness value for each pixel of the plurality of pixels, wherein the multiplication circuit is configured at least to multiply the brightness value for each pixel by a dimming factor associated with the pixel to obtain modified image data, wherein the dimming factor for each pixel of a first subset of the pixels at least is a function of a normalized distance between a center of the respective pixel and a spline of the display; and display driver circuitry configured to provide the modified image data to the plurality of pixels.

11. The display circuitry defined in claim 10, further comprising a gain table that includes the dimming factor for each pixel, wherein the dimming factor for each pixel decreases as the distance between the center of the pixel and the spline increases.

12. The display circuitry defined in claim 10, wherein the dimming factor for pixels that are greater than one pixel width outside of the spline is 0.

13. The display circuitry defined in claim 10, wherein the first subset of pixels comprises pixels having a center outside of the spline.

14. A method of operating a display that has a plurality of pixels and at least one curved edge, wherein a spline outlines the at least one curved edge, the method comprising:

providing image data to the display, wherein the image data comprises brightness levels for each pixel in the plurality of pixels;

modifying the image data based on dimming factors, wherein each pixel has a respective dimming factor, wherein the dimming factor for each pixel at least is associated with a location of the respective pixel, and wherein the dimming factor for each pixel having a center outside of the spline at least is associated with a normalized distance between the respective pixel and the spline; and displaying an image using the plurality of pixels based on the modified image data.

15. The display circuitry defined in claim 13, wherein each pixel of a second subset of pixels has a center inside of the spline and wherein each pixel of the second subset of pixels has a dimming factor of 1.

* * * * *